US006779848B1

(12) United States Patent
Sanders et al.

(10) Patent No.: US 6,779,848 B1
(45) Date of Patent: Aug. 24, 2004

(54) PORTABLE PATIENT TRANSFER ASSIST SYSTEM

(76) Inventors: Addie Sanders, 4805 Winfree Dr., Houston, TX (US) 77021; Torey Robinson, 4805 Winfree Dr., Houston, TX (US) 77021

( * ) Notice: Subject to any disclaimer, the term of this patent is extended or adjusted under 35 U.S.C. 154(b) by 60 days.

(21) Appl. No.: 10/441,323

(22) Filed: May 19, 2003

(51) Int. Cl.[7] ..... A47C 1/02
(52) U.S. Cl. ..... 297/339; 297/DIG. 10
(58) Field of Search ..... 297/411.35, 411.34, 297/183.9, DIG. 10, 338, 339, 344.12, 344.18, 344.19

(56) References Cited

U.S. PATENT DOCUMENTS 2,980,170 A * 4/1961 Bechtold
3,473,174 A 10/1969 Cool
3,479,087 A 11/1969 Burke
4,369,997 A 1/1983 Desanta
4,573,736 A 3/1986 Levenberg
4,778,216 A * 10/1988 Stupakis
5,435,623 A * 7/1995 Kapec et al.
6,296,310 B1 * 10/2001 Laudenslayer et al.

* cited by examiner

*Primary Examiner*—Milton Nelson, Jr.

(57) ABSTRACT

A portable patient transfer assist system for improving the mobility and independence of persons with limited range of motion. The portable patient transfer assist system includes a base assembly is designed for resting upon a horizontal support surface, a lift assembly operationally coupled to the base assembly having a stored position and an extended position and being fully adjustable between the stored and the extended positions, a seat assembly operationally coupled to a top end of the lift assembly designed for being sat upon by the user.

13 Claims, 2 Drawing Sheets

PORTABLE PATIENT TRANSFER ASSIST SYSTEM

BACKGROUND OF THE INVENTION

1. Field of the Invention

The present invention relates to transfer lift devices and more particularly pertains to a new portable patient transfer assist system or improving the mobility and independence of persons with limited range of movement concerns.

2. Description of the Prior Art

The use of transfer lift devices is known in the prior art. U.S. Pat. No. 4,573,736 describes a device for assisting a patient to stand. Another type of transfer lift devices is U.S. Pat. No. 3,473,174 having an apparatus to assist a patient on and off a toilet.

While these devices fulfill their respective, particular objectives and requirements, the need remains for a system that is superior in improving the mobility of patients by providing an easily transportable and easily operated transfer assist system

SUMMARY OF THE INVENTION

The present invention meets the needs presented above by providing a compact transportable device having a pneumatic lift for aiding in transitioning between sitting and standing.

Another object of the present invention is to provide a new portable patient transfer assist system that can be easily taken with the user to make facilities in locations being visited fully accessible.

Still another object of the present invention is to provide a new portable patient transfer assist system that reduces the likelihood of injury in transitioning between standing and sitting positions.

To this end, the present invention generally comprises a base assembly is designed for resting upon a horizontal support surface, a lift assembly operationally coupled to the base assembly having a stored position and an extended position and being fully adjustable between the stored and the extended positions, a seat assembly operationally coupled to a top end of the lift assembly designed for being sat upon by the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other. than those set forth above will become apparent when consideration is given to the following detailed description thereof. Such description makes reference to the annexed drawings wherein.

DESCRIPTION OF THE PREFERRED EMBODIMENT

Figure 1:
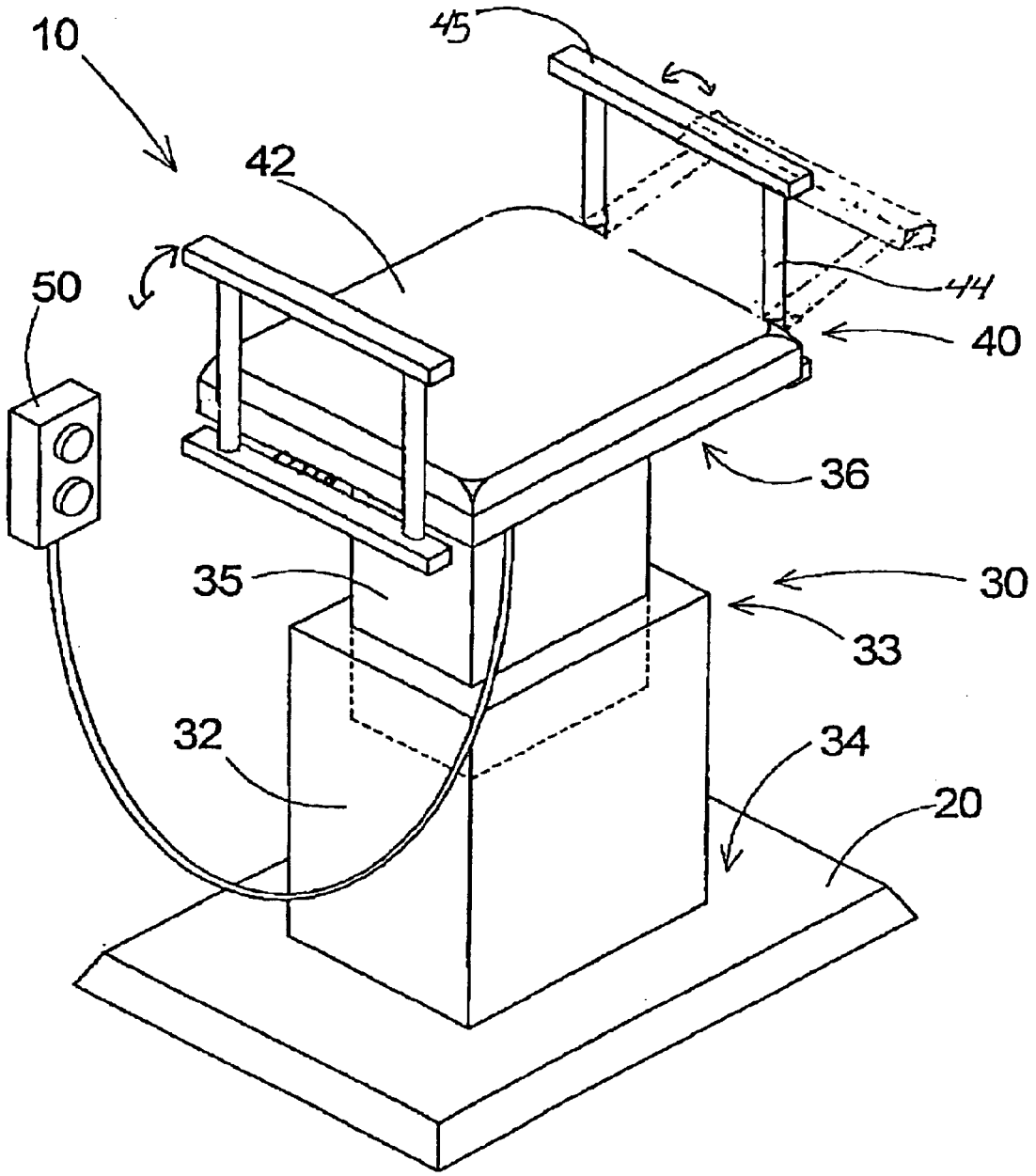
FIG. 1 is a schematic perspective view of a new portable patient transfer assist system according to the present invention.
Figure 2:
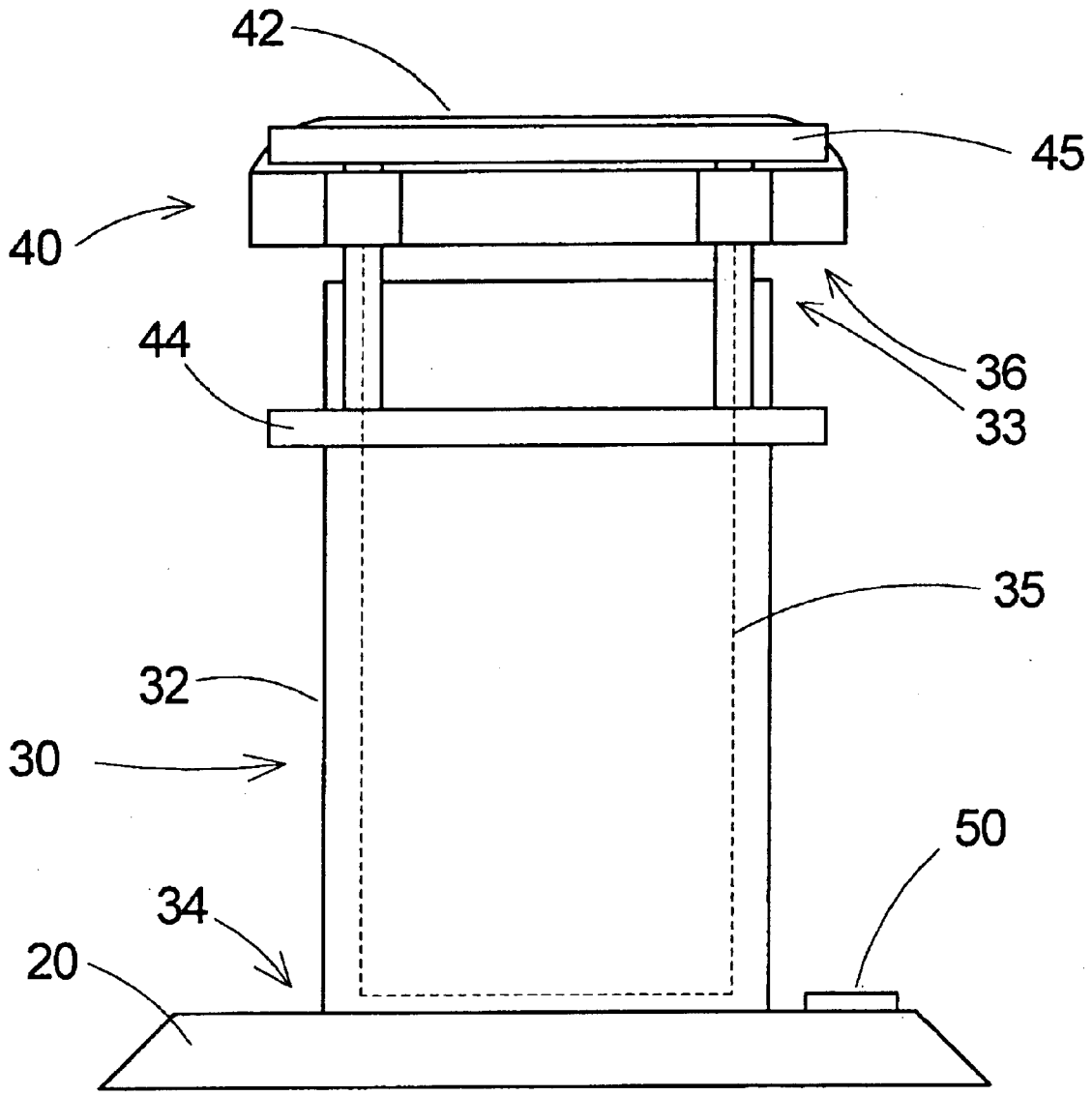
FIG. 2 is a schematic side view of the present invention.

With reference now to the drawings, and in particular to FIGS. 1 and 2 thereof, a new portable patient transfer assist system embodying the principles and concepts of the present invention and generally designated by the reference numeral 10 will be described.

As best illustrated in FIGS. 1 and 2, the portable patient transfer assist system 10 generally comprises a base assembly 20, a lift assembly 30, a seat assembly 40, and a control assembly 50. The base assembly 20 is designed for resting upon a horizontal support surface.

The lift assembly 30 preferably is operationally coupled to the base assembly 20. The lift assembly 30 has a stored position and an extended position. The lift assembly 30 is fully adjustable between the stored and the extended positions.

The seat assembly 40 is preferably operationally coupled to a top end 36 of the lift assembly 30. The seat assembly 40 further comprises a main member 42, which is operationally couplable to the top end 36 of the lift assembly 30. The main member 42 is positioned horizontally. The main member 42 includes a right side and a left side. The main member 42 is designed for being sat upon by the user. The seat assembly 40 further comprises a pair of handle members 44. Each one of the handle members 44 is operationally coupled to and associated one of the right and left sides of the main member 42. The handle members 44 provide a gripping point for the user to enhance the users stability.

In an embodiment each one of the pair of handle members 44 is pivotally coupled to the main member 42. Each one of the pair of handle members 44 has an extended position defined by a first rail 45 of the handle member 45 being positioned above the main member 42. The extended position facilitates the user remaining on the main member 42 during operation of the lift assembly 30. The handle members 44 may be locked into the extended position to provide additional support for the user when transitioning positions or from one seat to another. Each one of the pair of handle members 44 has a retracted position defined by the first rail 45 of the handle member 44 being positioned below the main member 42. The retracted position facilitating the user transferring onto and off of the main member 42.

The control assembly 50 is operationally coupled to the lift assembly 30. The control assembly 50 facilitates adjustment of the lift assembly 30 between the stored positions and the extended position.

The lift assembly 30 further comprises an outer housing 32 and a ram member 35. The outer housing 32 includes an upper end 33 and a lower end 34. The lower end 34 of the outer housing member 32 is operationally couplable to the base assembly 20. The outer housing member 32 is substantially hollow. The ram member 35 is positionable within the outer housing 32 and is extendable from the upper end 33 of the outer housing 32. The ram member 35 is slideably adjustable within the outer housing 32. The ram member 35 has a stored position and an extended position. The ram member 35 is fully adjustable between the stored and the extended positions. The ram member 35 includes a top end 36, which is operationally couplable to the main member 42.

In a preferred embodiment the ram member 35 is a pneumatic ram.

In a further embodiment the control assembly 50 is positioned within the base assembly 20. The control assembly 50 is actuated by a foot of the user.

In another embodiment the control assembly 50 is coupled to the main member 42, and the control assembly 50 is actuated by a hand of the user.

In a further embodiment the system 10 includes an overall width of 12 inches to facilitate positioning in tight locations.

While the present invention is lightweight and easily transportable in its fully assembled form, the invention may be disassembled into its major constituent components to further aid in its portability.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A portable patient transfer assist system comprising:

a base assembly adapted for resting upon a horizontal support surface;

a lift assembly operationally coupled to said base assembly, said lift assembly having a stored position and an extended position, said lift assembly being fully adjustable between said stored and said extended positions;

wherein said lift assembly further comprises:

a outer housing member having an upper end and a lower end, said lower end of said outer housing member being operationally couplable to said base assembly, said outer housing member being substantially hollow;

a ram member positionable within said outer housing member, said ram member being extendable from said upper end of said outer housing, said ram member being slideably adjustable within said outer housing member, said ram member having a stored position and an extended position, said ram member being fully adjustable between said stored and said extended positions, said ram member having a top end, said top end of said ram member being operationally couplable to a main member;

said ram member being a pneumatic ram;

a control assembly operationally coupled to said lift assembly, said control assembly facilitating adjustment of said lift assembly between said stored position and said extended position; and a seat assembly operationally coupled to a top end of said lift assembly.

2. The system of claim 1, wherein said seat assembly further comprises a main member said main member being operationally couplable to said top end of said lift assembly, said main member being positioned horizontally, said main member having a right side and a left side, said main member adapted for being sat upon by a user.

3. The system of claim 2, wherein said seat assembly further comprises a pair of handle members, each one of said handle members being operationally coupled to and associated with one of said right and left sides of said main member, said handle members providing a gripping point for the user to enhance stability of the user.

4. The system of claim 3, wherein each one of said pair of handle members being pivotally coupled to said main member, each one of said pair of handle members having an extended position defined by a first rail of said handle member being positioned above said main member, said extended position facilitating the user remaining on said main member during operation of said lift assembly, each one of said pair of handle members having a retracted position defined by said first rail of said handle member being positioned below said main member, said retracted position facilitating the user transferring onto and off of said main member.

5. The system of claim 1, further comprising a control assembly operationally coupled to said lift assembly, said control assembly facilitating adjustment of said lift assembly between said stored position and said extended position.

6. The system of claim 5, wherein said control assembly being positioned with said base assembly, said control assembly being actuated by a foot of a user.

7. The system of claim 1 wherein said system having an overall width of 12 inches.

8. The system of claim 1, wherein said control assembly being positioned with said base assembly, said control assembly being actuated by a foot of a user.

9. The system of claim 1, wherein said control assembly being coupled to said main member, said control assembly being actuated by a hand of a user.

10. A portable patient transfer assist system comprising:

a base assembly adapted for resting upon a horizontal support surface;

a lift assembly operationally coupled to said base assembly, said lift assembly having a stored position and an extended position, said lift assembly being fully adjustable between said stored and said extended positions; and a seat assembly operationally coupled to a top end of said lift assembly;

said seat assembly further comprises a main member, said main member being operationally couplable to said top end of said lift assembly, said main member being positioned horizontally, said main member having a right side and a left side, said main member adapted for being sat upon by a user;

said seat assembly further comprises a pair of handle members, each one of said handle members being operationally coupled to an associated one of said right and left sides of said main member, said handle members providing a gripping point for the user to enhance stability of the user;

wherein each one of said pair of handle members being pivotally coupled to said main member, each one of said pair of handle members having an extended position defined by a first rail of said handle member being positioned above said main member, said extended position facilitating the user remaining on said main member during operation of said lift assembly, each one of said pair of handle members having a retracted position defined by said first rail of said handle member being positioned below said main member, said retracted position facilitating the user transferring onto and off of said main member;

a control assembly operationally coupled to said lift assembly, said control assembly facilitating adjustment of said lift assembly between said stored position and said extended position;

wherein said system having an overall width of 12 inches;

said lift assembly further comprises:

a outer housing member having an upper end and a lower end, said lower end of said outer housing member being operationally couplable to said base assembly, said outer housing member being substantially hollow;

a ram member positionable within said outer housing member, said ram member being extendable from said upper end of said outer housing, said ram member being slideably adjustable within said outer housing, said ram member having a stored position and an extended position, said ram member being fully adjustable between said stored and said extended positions, said ram member having a top end, said top end of said ram member being operationally couplable to said main member.

11. The system of claim 10, wherein said ram member being a pneumatic ram.

12. The system of claim 10, wherein said control assembly being positioned with said base assembly, said control assembly being actuated by a foot of the user.

13. The system of claim 10, wherein said control assembly being coupled to said main member, said control assembly being actuated by a hand of the user.

* * * * *